US008545045B2

(12) United States Patent
Tress

(10) Patent No.: US 8,545,045 B2
(45) Date of Patent: Oct. 1, 2013

(54) MODULAR LED LIGHTING SYSTEMS AND KITS

(75) Inventor: Christopher Tress, Poland, OH (US)

(73) Assignee: Rev-A-Shelf Company, LLC, Jeffersontown, KY (US)

( * ) Notice: Subject to any disclaimer, the term of this patent is extended or adjusted under 35 U.S.C. 154(b) by 208 days.

(21) Appl. No.: 13/181,161

(22) Filed: Jul. 12, 2011

(65) Prior Publication Data

US 2013/0016500 A1 Jan. 17, 2013

(51) Int. Cl.
*F21V 21/00* (2006.01)

(52) U.S. Cl.
USPC ..... 362/217.17; 362/219; 362/225; 362/640; 362/555; 362/133; 362/800; 315/36; 315/312; 315/313; 315/185 R; 439/78; 439/515; 439/920; 439/924.1

(58) Field of Classification Search
USPC ..... 362/219, 133, 217.13, 217.17, 800, 362/555, 249.02, 249.01, 249.11, 217.15, 362/225, 270, 640; 315/36, 362, 312–314, 315/185 R; 439/78, 515, 920, 924.1
See application file for complete search history.

(56) References Cited

U.S. PATENT DOCUMENTS 5,559,393 A * 9/1996 Nilssen ..... 315/58
6,283,612 B1 * 9/2001 Hunter ..... 362/240
6,346,777 B1 * 2/2002 Kim ..... 315/185 S
D532,143 S 11/2006 Woertler
D532,544 S 11/2006 Woertler
7,384,166 B2 6/2008 Tress et al.
7,401,946 B2 * 7/2008 Laukhuf ..... 362/270
7,821,212 B2 * 10/2010 Wray ..... 315/312
8,104,928 B1 * 1/2012 Horn ..... 362/287
8,115,393 B2 * 2/2012 Neal et al. ..... 315/36
8,313,212 B1 * 11/2012 Mayer et al. ..... 362/219
8,344,410 B2 * 1/2013 Wendler et al. ..... 257/99
2002/0118537 A1 * 8/2002 Segretto ..... 362/226
2005/0007031 A1 * 1/2005 Hyder ..... 315/276
2006/0049368 A1 * 3/2006 Culbert ..... 250/503.1
2007/0115666 A1 * 5/2007 Thomas et al. ..... 362/294
2007/0217209 A1 * 9/2007 Wong ..... 362/418
2008/0055915 A1 * 3/2008 Lynch et al. ..... 362/373
2009/0073692 A1 * 3/2009 Berger et al. ..... 362/249.02
2010/0008090 A1 * 1/2010 Li et al. ..... 362/249.03
2010/0135020 A1 * 6/2010 Moore ..... 362/249.02
2010/0208458 A1 * 8/2010 Weimer et al. ..... 362/235
2010/0271804 A1 * 10/2010 Levine ..... 362/35
2010/0277098 A1 * 11/2010 Sarna ..... 315/294
2011/0255287 A1 * 10/2011 Li ..... 362/249.02

(Continued)

*Primary Examiner* — Anne Hines
*Assistant Examiner* — Jose M Diaz
(74) *Attorney, Agent, or Firm* — Brinks Hofer Gilson & Lione

(57) ABSTRACT

Modular LED lighting systems can provide under-cabinet lighting. According to some embodiments, an LED lighting system may be provided with at least one LED light strip, a switch unit, and a removable electrical connector electrically connecting the at least one LED light strip to the switch unit in an end-to-end configuration. According to other embodiments, a modular under-cabinet LED lighting system may be provided having a plurality of LED light strip units having a female power receptacle at each end thereof, and at least one removable electrical connector received within respective female power receptacles at respective ends of an adjacent pair of the LED light strip units to electrically connect the pair of LED light strip units in series one to another in an end-to-end configuration. Because of the modular nature of the various components, a lighting system tailored to a specific under-cabinet lighting need can be provided.

21 Claims, 3 Drawing Sheets

(56) References Cited

U.S. PATENT DOCUMENTS

2012/0002417 A1* 1/2012 Li ..... 362/249.02
2012/0106202 A1* 5/2012 Chien ..... 362/641
2012/0218746 A1* 8/2012 Winton ..... 362/219

* cited by examiner

MODULAR LED LIGHTING SYSTEMS AND KITS

FIELD OF THE INVENTION

The present invention relates generally to lighting systems and kits which provide task lighting to a work surface (e.g., countertops). In preferred embodiments, the present invention relates to modular lighting systems which employ light emitting diodes (LEDs) and are especially suitable for use under cabinetry.

BACKGROUND AND SUMMARY OF THE INVENTION

Under-cabinet lighting is a well known and popular option for homeowners to provide task lighting directly onto countertops and like work surfaces. Under-cabinet lighting therefore minimizes shadowing of the task surface (e.g., countertops) that may otherwise occur if only overhead lighting systems were installed.

The art is replete with various proposals to provide lighting fixtures under cabinetry. For example, U.S. Pat. No. 7,384,166 (the entire content of which is expressly incorporated hereinto by reference) discloses under-cabinet lighting systems whereby lighting fixtures are capable of being hidden from view by a decorative molding forming a part of the cabinetry. The decorative molding according to such patent also serves the dual purpose of a wiring raceway and a physical support for the lighting fixture.

While the proposals in the prior art are suitable for their intended purpose to provide task lighting to surfaces under cabinetry, improvements are still needed. For example, light emitting diodes (LEDs) have become an increasingly popular source of lighting due to their relatively low electrical power demand requirements and relatively smaller size as compared to comparable incandescent lighting. It would therefore be especially be desirable if under-cabinet LED lighting fixtures could be provided which are easy to install and operate. It is therefore towards fulfilling such needs that the present invention is directed.

The present invention may thus be embodied in a modular under-cabinet LED lighting systems that provide under-cabinet lighting. According to some embodiments, the LED lighting system may be provided with at least one LED light strip, a switch unit, and a removable electrical connector electrically connecting the at least one LED light strip to the switch unit in an end-to-end configuration. According to other embodiments, a modular under-cabinet LED lighting system may be provided having a plurality of LED light strip units having a female power receptacle at each end thereof, and at least one removable electrical connector received within respective female power receptacles at respective ends of an adjacent pair of the LED light strip units to electrically connect the pair of LED light strip units in series one to another in an end-to-end configuration. Because of the modular nature of the various components, a lighting system tailored to a specific under-cabinet lighting need can be provided.

The female power receptacles associated with the LED light strip units and switch units preferably include a slot for receiving the removable electrical connector. In some preferred embodiments, the removable electrical connector is an H-shaped connector. If configured in such a manner, the removable electrical connector may thus include a pair of parallel positive and negative contact pins, and a transverse electrically insulated cross-support pin.

The switch unit that may be provided could be embodied in a push-button switch unit, a touch-pad sensor switch unit or a motion detector switch unit.

Some embodiments of the invention will include an end power connection unit which connects a terminal end of one of the LED light strip unit or switch unit to a source of electrical power. The end power connection unit of such embodiments may comprise a connector plug member having a pair of connection pins for insertion into the terminal end of one of the LED light strip unit or switch unit, a power source plug, and a length of electrical wiring connecting the connector plug member and the power source plug.

The LED lighting strip unit according to other preferred embodiments may comprise a base defining an interior space, an LED lighting strip mounted in the interior space of the base, and a lens attached to the base to cover the LED lighting strip.

The various component units may be provided as a kit for assembly on site by an installer to provide the desired under-cabinet lighting needs.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

DETAILED DESCRIPTION OF THE INVENTION

Figure 1:
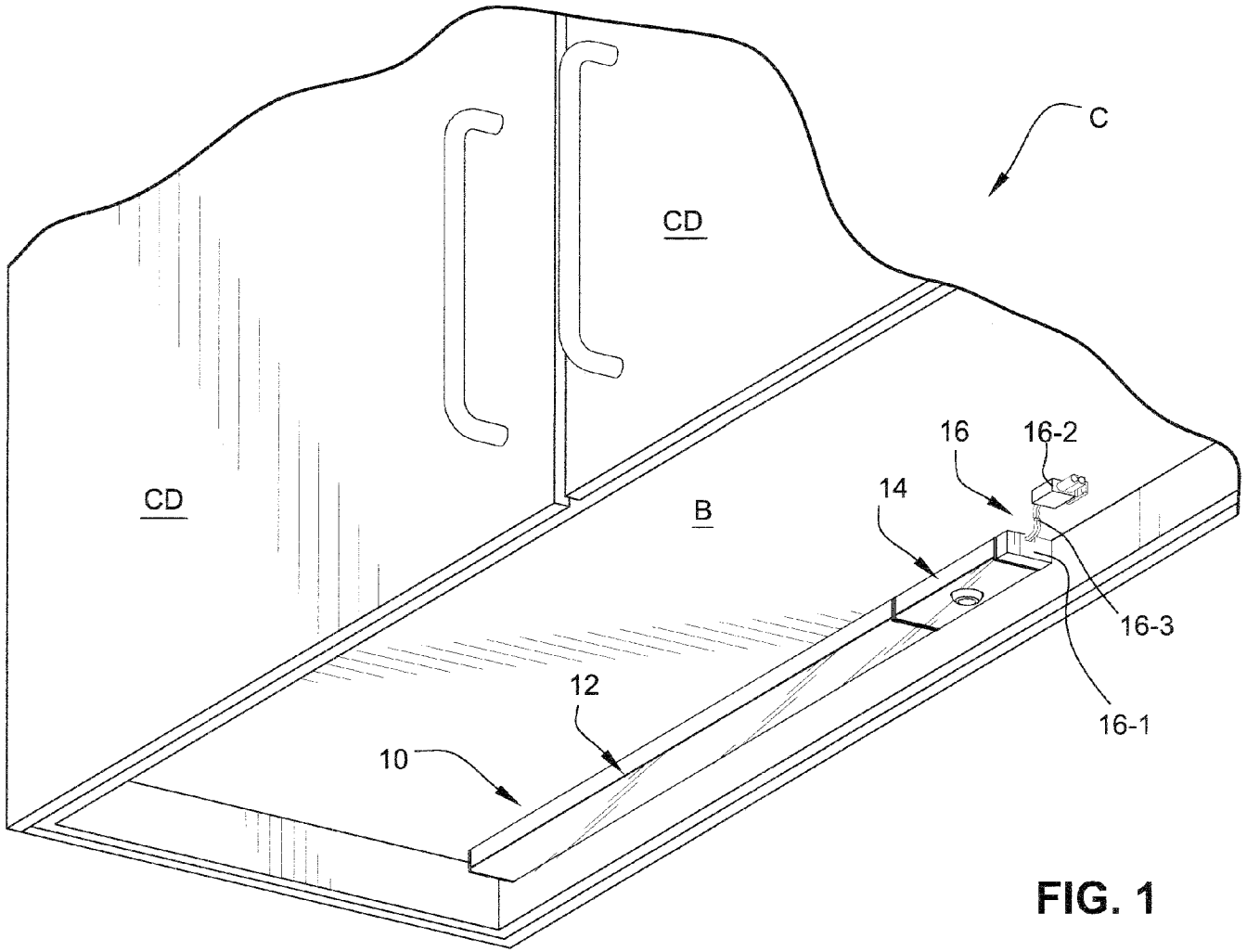
FIG. 1 is an underneath perspective view of cabinetry on which one preferred embodiment of a modular LED under-cabinet lighting system in accordance with the present invention has been installed.
Figure 2:
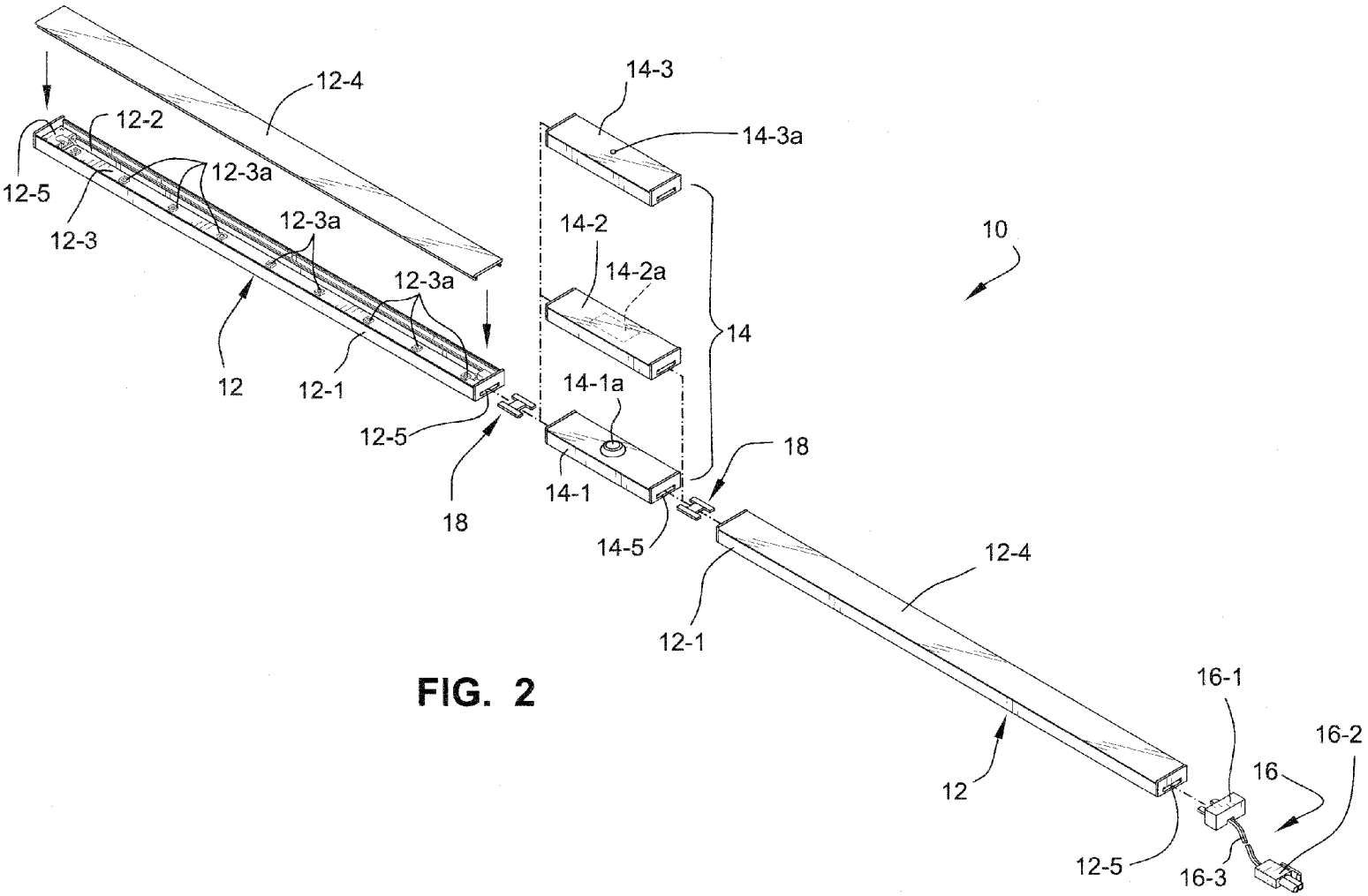
FIG. 2 is perspective view, partly exploded, of one exemplary modular LED under-cabinet lighting system showing individual components thereof.
Figure 3:
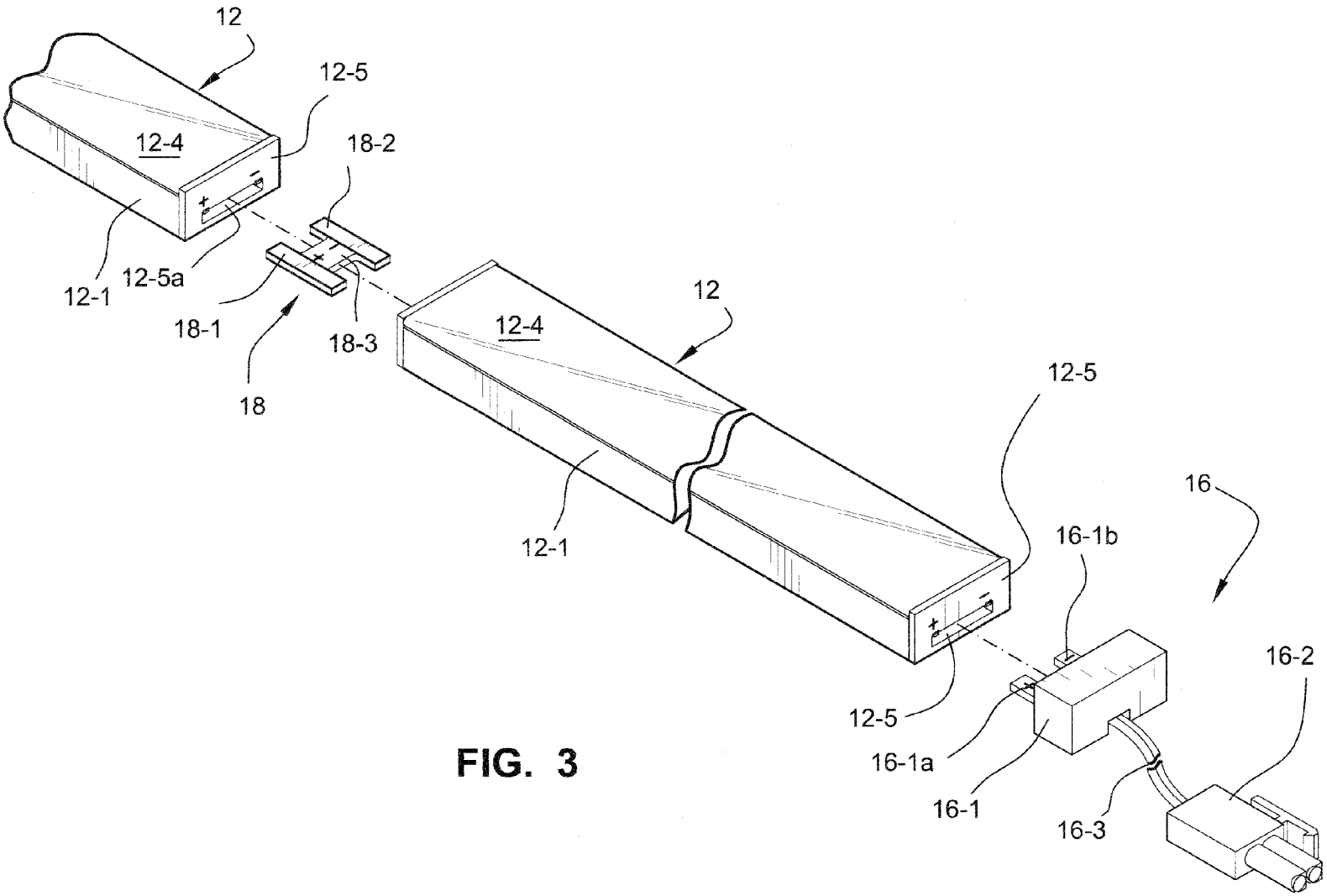
FIG. 3 is an enlarged perspective view of an adjacent pair of serially connected LED lighting strip units showing the manner in which such units are electrically connected to one another and to an end power connection unit 16.

A presently preferred embodiment of a modular LED under-cabinet lighting system 10 in accordance with the present invention is depicted in accompanying FIGS. 1-3. In this regard, the lighting system 10 is generally comprised of at least one LED lighting strip unit 12, a switch unit 14 and an end power connection unit 16 attached to the bottom B of the cabinetry C. The cabinetry C is, in and of itself, conventional in that it is formed of a suitable cabinetry material (e.g., wood, composite laminates and/or molded plastics materials) with cabinetry doors CD which visibly hide internal storage shelves (not shown).

The various component parts of the modular LED light fixture 10 in accordance with the present invention are depicted more clearly in the exploded views of accompanying FIGS. 2 and 3. In this regard, the light fixture 10 is depicted in FIG. 2 as including a pair of LED light strip units 12 connected serially to one another by the switch unit 14. It will be understood that, due to the modular nature of the fixture 10, virtually any number of the light strip units 12, including a single strip unit 12 as shown in FIG. 1, may be connected end-to-end in a manner to be described in greater detail below in dependence upon the particular under cabinet lighting requirements.

As shown in FIG. 2, the LED lighting strip unit 12 includes a base 12-1 which defines an interior space 12-2. An LED light strip 12-3 is positioned in the interior space 12-2 of the base 12-1 so as to provide a light source. As is conventional, the LED strip 12-3 includes a plurality of individual LED elements 12-3*a* operatively associated with a PCB (printed circuit board) support. A light transparent or translucent lens 12-4 is attached to the base 12-1 so as to cover the LED elements 12-3*a* and allow light generated thereby to be directed toward the task surface under the cabinetry C.

The switch units 14 can be of any desired variety so as to allow the light strip units 12 to be energized and thereby cause the individual LED elements 12-3*a* to illuminate. For example, any one of a push-button switch unit 14-1 (which energizes/deenergizes the LED elements 12-3*a* by means of physical push button 14-1*a* being manually depressed), a touch-pad sensor switch unit 14-2 (which energizes/deenergizes the LED elements 12-3*a* by means of a user touching a touch pad 14-2*a*) or a motion detector switch unit 14-3 (which energizes/deenergizes the LED elements 12-3*a* by means of detecting a user's hand motion in the vicinity of a motion detector 14-3*a*) may be employed as the switch unit 14 which is operatively connected to one or more LED lighting strip unit 12.

The LED light strip units 12 include female power receptacles 12-5 at each end (see FIG. 2) which are electrically connected to the LED light strips 12-3. Electrical connection between adjacent LED light strip units 12 and/or between an LED light strip unit 12 and a switch unit 14 is effected by a removable connector clip 18 inserted into the connection slot 12-5*a* of the power receptacles 12-5. As is perhaps best shown in the enlarged view of FIG. 3, the connector clip 18 is a planar structure which is generally H-shaped in configuration and includes parallel positive and negative contact pins 18-1, 18-2, respectively, separated from one other physically and electrically by a transverse electrically insulated cross-support pin 18-3. The connector clip 18 is also employed so as to connect a switch unit 14 to an end of an LED light strip unit 12 by virtue of the power receptacles 14-5 and their associated slot at each end thereof.

Although not depicted, correct polarity can be ensured by providing one of the contact pins 18-1, 18-2 with a protruding boss which is capable of mating with a correspondingly configured recess associated with the connection slot 12-5*a* of the power receptacle 12-5. Alternatively, the slot 12-5*a* could include the protruding boss structure which mates with an elongate recessed slot formed in one of the contact pins 18-1, 18-2.

Electrical power from a power source (not shown) is provided to the LED light strip unit 12 by the end power connection unit 16 comprised of a strip connector plug member 16-1 having a pair of connection pins 16-1*a*, 16-1*b* and a power source plug 16-2 at terminal ends of a suitable length of electrical wiring 16-3. Connecting the plug 16-2 to a suitable power source (not shown) remotely positioned with respect to the cabinetry C will thus provide electrical power of proper magnitude and polarity to the LED light strip unit(s) 12.

In use, an LED light strip unit 12 may be electrically connected end-to-end to another LED light strip unit 12 and/or to a switch unit 14 so as to form an elongate modular LED under-cabinet lighting system 10. The end most modular unit (i.e., either a terminal end of one of the LED light strip units 12 or a switch unit 14 may then be connected to the power connection unit 16. The LED under-cabinet lighting system 10 may be mounted under the cabinetry C by any conventional means. In this regard, one or more mounting clips (not shown) may first be installed to the bottom B of the cabinetry C (e.g., by screws, adhesive, hook-and-loop fasteners or the like). The LED under-cabinet lighting system 10 may then be engaged with the mounting clips. A detent may be provided with the mounting clips in which case the base 12-1 of the LED light strip unit 12 may be provided with an elongate slot with which it may be engaged.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A modular LED lighting system comprising: at least one LED light strip; a switch unit; and a removable electrical connector electrically connecting the at least one LED light strip to the switch unit in an end-to-end configuration, wherein the removable electrical connector is an H-shaped connector.

2. The lighting system of claim 1, wherein each end of the at least one LED light strip and the switch unit includes a female power receptacle which is configured to receive therein the removable electrical connector.

3. The lighting system of claim 1, wherein the female power receptacle includes a slot for receiving the removable electrical connector.

4. The lighting system of claim 1 or 3, wherein the removable electrical connector includes a pair of parallel positive and negative contact pins, and a transverse electrically insulated cross-support pin.

5. The lighting system of claim 1, wherein the switch unit comprises a push-button switch unit, a touch-pad sensor switch unit or a motion detector switch unit.

6. The lighting system of claim 1, further comprising an end power connection unit which connects a terminal end of one of the LED light strip unit or switch unit to a source of electrical power.

7. The lighting system of claim 6, wherein the end power connection unit comprises a connector plug member having a pair of connection pins for insertion into the terminal end of one of the LED light strip unit or switch unit, a power source plug, and a length of electrical wiring connecting the connector plug member and the power source plug.

8. The lighting system of claim 1, wherein the LED lighting strip unit comprises a base defining an interior space, an LED lighting strip mounted in the interior space of the base, and a lens attached to the base to cover the LED lighting strip.

9. A modular lighting system comprising: a plurality of LED light strip units having a female power receptacle at each end thereof; at least one removable electrical connector received within respective female power receptacles at respective ends of an adjacent pair of the LED light strip units to electrically connect the pair of LED light strip units in series one to another in an end-to-end configuration, wherein the removable electrical connector is an H-shaped connector.

10. The lighting system of claim 9, wherein the female power receptacle includes a slot for receiving the removable electrical connector.

11. The lighting system of claim 9, wherein the removable electrical connector includes a pair of parallel positive and negative contact pins, and a transverse electrically insulated cross-support pin.

12. The lighting system of claim 9, further comprising a switch unit connected to a terminal end of one of pair of LED light strip units.

13. The lighting system of claim 9, further comprising an end power connection unit which connects a terminal end of one of the LED light strip units to a source of electrical power.

14. The lighting system of claim 13, wherein the end power connection unit comprises a connector plug member having a pair of connection pins for insertion into the terminal end of one of the LED light strip units, a power source plug, and a length of electrical wiring connecting the connector plug member and the power source plug.

15. The lighting system of claim 9, wherein the LED lighting strip unit comprises a base defining an interior space, an LED lighting strip mounted in the interior space of the base, and a lens attached to the base to cover the LED lighting strip.

16. A kit for assembling a lighting system comprising: a plurality of LED light strip units having a female power receptacle at each end thereof at least one switch unit having a female power receptacle at each end thereof; a plurality of removable electrical connectors connectable with a respective female power receptacle of an adjacent pair of the LED light strip units or a respective female receptacle of one of the LED light strip units and an adjacent switch unit in series in an end-to-end configuration; and an end power plug unit connectable to a female power receptacle at a terminal end of one of the LED light strip units or a switch unit for connection to a source of electrical power, wherein each of the removable electrical connectors is an H-shaped connector.

17. The kit of claim 16, wherein the female power receptacles of the LED light strip units and the at least one switch unit includes a slot for receiving a respective one of the removable electrical connectors therein.

18. The kit of claim 16, wherein the removable electrical connectors include a pair of parallel positive and negative contact pins, and a transverse electrically insulated cross-support pin.

19. The kit of claim 16, wherein the at least one switch unit comprises a push-button switch unit, a touch-pad sensor switch unit or a motion detector switch unit.

20. The kit of claim 16, wherein the end power connection unit comprises a connector plug member having a pair of connection pins for insertion into the female power receptacle at a terminal end of one of the LED light strip units or switch unit, a power source plug, and a length of electrical wiring connecting the connector plug member and the power source plug.

21. The kit of claim 16, wherein the LED lighting strip unit comprises a base defining an interior space, an LED lighting strip mounted in the interior space of the base, and a lens attached to the base to cover the LED lighting strip.

* * * * *